US005101522A

United States Patent [19]

Prian

[11] Patent Number: 5,101,522

[45] Date of Patent: Apr. 7, 1992

[54] ANTI-SPLASH SHOWER CURTAIN SUPPORT FIXTURE

[76] Inventor: John L. Prian, 631 El Jina La., Ojai, Calif. 93023

[21] Appl. No.: 560,046

[22] Filed: Jul. 30, 1990

[51] Int. Cl.[5] ..... A47K 3/14

[52] U.S. Cl. ..... 4/610; 4/608; 4/609; 4/558

[58] Field of Search ..... 4/607-610, 4/567, 568, 570, 557, 558

[56] References Cited

U.S. PATENT DOCUMENTS

| | | | |
|---|---|---|---|
| 620,648 | 3/1899 | Goldsmith . | |
| 1,005,239 | 10/1911 | Luan . | |
| 1,112,159 | 9/1914 | Rossiter . | |
| 2,049,061 | 7/1936 | Hoegger, Sr. | 4/609 X |
| 2,074,928 | 3/1937 | Miller . | |
| 2,219,075 | 10/1940 | Veau | 4/610 |
| 2,239,247 | 4/1941 | Pollina . | |
| 2,313,496 | 3/1943 | Adams | 4/607 X |
| 2,511,762 | 6/1950 | Barnett . | |
| 2,703,179 | 3/1955 | Giambra, Jr. . | |
| 2,748,908 | 6/1956 | Jacobson et al. | 4/607 X |
| 2,778,030 | 1/1957 | Goche | 4/610 |
| 2,885,000 | 5/1959 | Merrill | 4/607 X |
| 2,891,708 | 6/1959 | Dover . | |
| 2,923,013 | 2/1960 | Wasserman | 4/610 |
| 3,101,485 | 8/1963 | Kirshenbaum | 4/567 |
| 3,418,665 | 12/1968 | Lond | 4/610 |
| 3,766,572 | 10/1973 | Wright | 4/610 |
| 4,117,557 | 10/1978 | McPeak et al. | 4/610 |
| 4,385,409 | 5/1983 | File et al. | 4/608 |
| 4,461,056 | 7/1984 | Solinski | 4/610 X |
| 4,769,862 | 9/1988 | Skrzelowski | 4/605 X |

FOREIGN PATENT DOCUMENTS

| | | | |
|---|---|---|---|
| 0272554 | 6/1988 | European Pat. Off. | 4/607 |

*Primary Examiner*—Henry J. Recla
*Assistant Examiner*—Casey Jacyna

[57] ABSTRACT

A shower curtain support fixture for hanging a shower curtain above a bath tub includes a generally U-shaped structure having an elongated main portion and a pair opposite end portions extending generally transverse to the main portion. A slot is defined in a bottom side of the U-shaped structure extending along its main portion and opposite end portions so as to provide a generally U-shaped guide track in the structure. Shower curtain hanger devices are inserted through the slot and slidable individually along the track provided by the slot. Aligned holes formed through the opposite end portions of the structure facilitate mounting of the structure with its opposite end portions extending in flush relation to oppositely facing bathroom walls disposed at opposite ends of the bath tub such that a shower curtain hanging from the U-shaped structure by the plurality of hanger devices is extendable into the tube and along a front side of the tub and around front opposite corners thereof to effectively block water from splashing out of the tub over the front side and the front opposite corners of the tub.

1 Claim, 1 Drawing Sheet

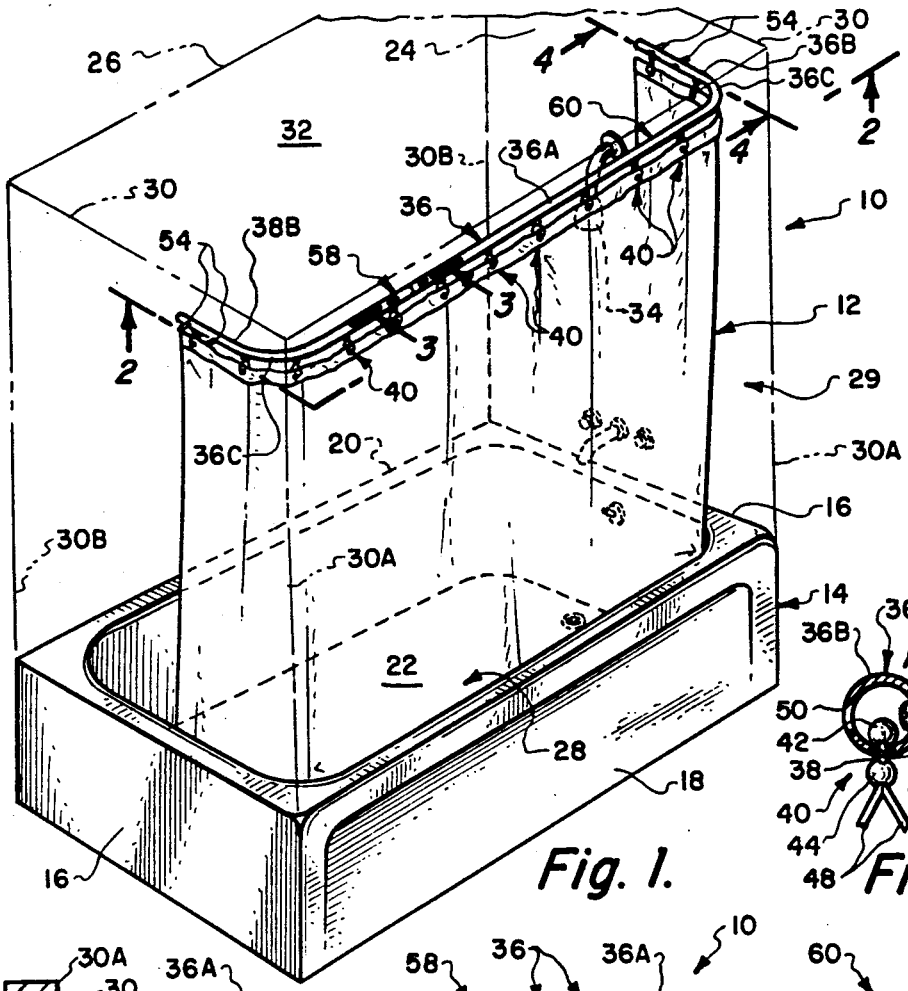
Fig. 1.
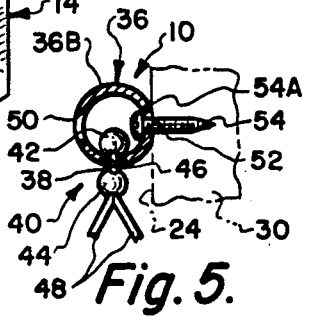
Fig. 5.
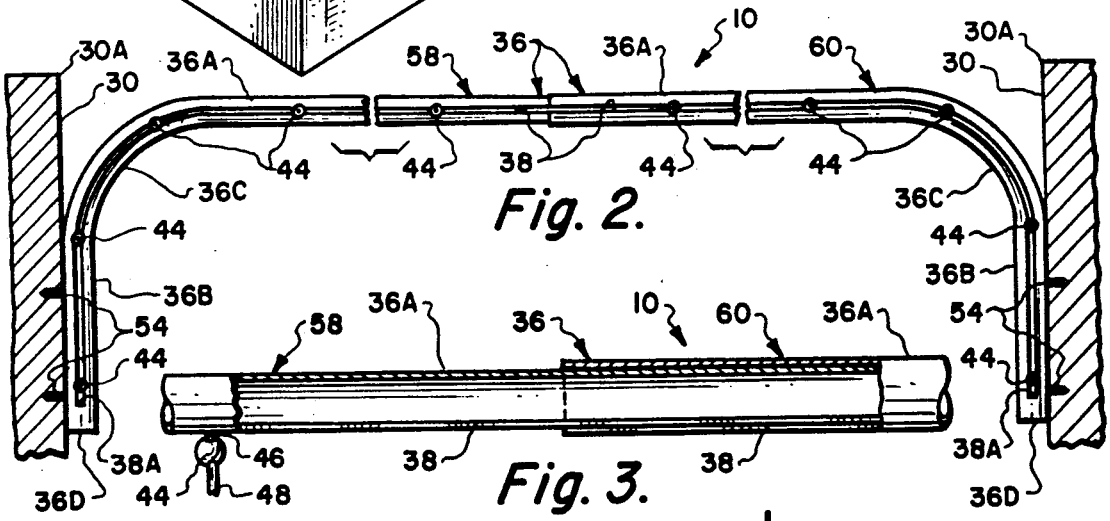
Fig. 2.
Fig. 3.
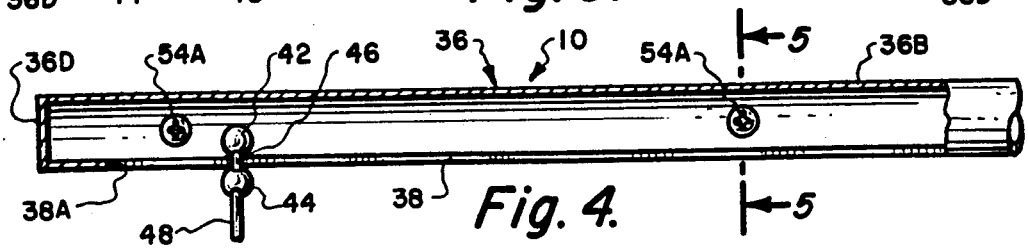
Fig. 4.

ANTI-SPLASH SHOWER CURTAIN SUPPORT FIXTURE

BACKGROUND OF THE INVENTION

The present invention generally relates to fixtures for supporting shower curtains and, more particularly, to an anti-splash shower curtain support fixture.

A conventional bath tub typically has a rectangular box-like configuration with opposite ends and opposite front and rear sides interconnected with one another and upstanding on a flat bottom. The bath tub is ordinarily located at an end or in an alcove of a bathroom enclosed by three of the bathroom walls extending in a rectangular configuration relative to one another. The three bathroom walls encompass and extend along the opposite ends and rear side of the bath tub but leave the bath tub open for access along its front side. A shower nozzle is usually mounted from one of the opposing bathroom walls above a corresponding one of the opposite ends of the tub. When the shower is turned on, a spray of water is projected from the nozzle generally downwardly into the tub.

A shower curtain is typically hung by an elongated straight support fixture or rod mounted above and parallel to the front side of the bath tub. The purpose of the hanging shower curtain is to prevent the spray of water issued by the shower nozzle from deflecting and splashing from the user's body and the tub interior and bathroom walls surrounding the tub into the rest of the bathroom during use of the shower.

The shower curtain support rod typically extends between the oppositely facing pair of bathroom walls located along the opposite ends of the bath tub. The support rod conventionally is composed of two straight tubular sections which are telescoped together and internally spring loaded to move apart. The telescoped sections of the support rod are retracted toward each other against the spring loading to permit wedging of the support rod between and engagement at its opposite ends with the oppositely facing bathroom walls, the wedged support rod being located above and parallel to the front side of the bath tub.

A shower curtain hanging down into the bath tub from such conventional straight support rod will usually adequately block water from deflecting and splashing out of the tub along the length of the front side of the tub. However, gaps and spaces are left above the front opposite corners of the tub between the opposite ends of the shower curtain and the oppositely facing bathroom walls. During normal use of the shower, water can easily be deflected and splashed from the tub through these gaps and spaces. Thus, the shower curtain hanging from the conventional straight support rod does not provide a complete enough barrier for preventing water from reaching the bathroom floor and eventually producing deterioration of the floor covering and/or flooding of the room below the bathroom.

Consequently, a need exists for a shower curtain support fixture which will solve the above-cited problems left unresolved by a conventional straight shower curtain rod.

SUMMARY OF THE INVENTION

The present invention provides a shower curtain support fixture designed to satisfy the aforementioned needs. The shower curtain support fixture of the present invention provides an effective and practical solution to the above-cited problems by adopting a configuration and mounting arrangement which provides an effective water barrier at the opposite front corners of the tub, thereby confining all water to the bath tub or shower area and eliminating water damage to the floor area and lower walls.

Accordingly, the present invention is directed to a shower curtain support fixture for hanging a shower curtain above a bath tub. The shower curtain support fixture comprises: (a) a generally U-shaped structure having an elongated main portion and a pair opposite end portions extending in generally transverse relation to the main portion; (b) means defining a generally U-shaped guide track on the structure extending along the main portion and the opposite end portions thereof; (c) means for hanging a shower curtain from said guide track and for moving the curtain along said track; and (d) means on the opposite end portions of the structure for facilitating mounting of the structure with its opposite end portions extending in flush relation to oppositely facing bathroom walls disposed at opposite ends of the bath tub such that a shower curtain hanging from the structure is extendable into the tube and along a front side of the tub and around front opposite corners thereof to effectively block water from splashing out of the tub over the front side and the front opposite corners of the tub.

More particularly, the U-shaped structure is defined by a pair of generally L-shaped support members being interfitted together. One of the L-shaped support members is telescopably inserted into the other to define the U-shaped structure and permit adjustment of the length of the main portion thereof. The track defining means is a slot formed in a bottom side of the U-shaped structure and extending along the main portion and the opposite end portions thereof. The shower curtain hanging means is a plurality of shower curtain hanger devices inserted through the slot in the bottom side of the structure and slidable individually along the track provided by the slot. The means for facilitating mounting of the structure are a plurality of pairs of aligned holes formed through the opposite end portions of the structure.

These and other features and advantages of the present invention will become apparent to those skilled in the art upon a reading of the following detailed description when taken in conjunction with the drawings wherein there is shown and described an illustrate embodiment of the invention.

BRIEF DESCRIPTION OF THE DRAWINGS

In the following detailed description, reference will be made to the attached drawings in which:

FIG. 1 is a perspective view of a shower curtain support fixture installed over a bath tub in accordance with the present invention.

FIG. 2 is an enlarged bottom plan view of the shower curtain support fixture as seen along line 2—2 of FIG. 1.

FIG. 3 is an enlarged fragmentary longitudinal sectional view of the shower curtain support fixture as seen along line 3—3 or FIG. 1.

FIG. 4 is an enlarged fragmentary longitudinal sectional view of the shower curtain support fixture as seen along line 4—4 of FIG. 1.

FIG. 5 is a cross-sectional view of the shower curtain support fixture taken along line 5—5 of FIG. 4.

DETAILED DESCRIPTION OF THE INVENTION

Referring now to the drawings, and particularly to FIG. 1, there is shown a shower curtain support fixture, generally designated 10, constructed in accordance with the present invention, for hanging a shower curtain 12 above a bath tub 14. The bath tub 14 is composed of a pair of opposite ends 16 and opposite front and rear sides 18 and 20 integrally interconnected together and with a flat bottom 22. Also, pairs of front and rear corners 24 and 26 connect the opposite ends 16 with the front and rear sides 18 and 20 of the tub 14. Further, the opposite ends 16, front and rear sides 18 and 20, and front and rear corners 24 and 26, along with the bottom 22, define the interior 28 of the tub 14.

The bath tub 14 is disposed in a recess or enclosure 29 of a room, typically a bathroom. The enclosure 29 is formed by three walls 30 and 32. Two of the walls 30 of the enclosure 29 are end walls which face each other and are generally parallel to one another. The end walls 30 also extend along and above respective opposite ends 16 of the tub 14 and have front and rear vertical edges 30A and 30B located adjacent the front and rear corners 24 and 26 of the tub 14. The third wall 32 of the enclosure 29 is a rear wall which extends at right angles between and connects with the rear vertical edges 30B of the opposite end walls 30. The rear wall 32 also extends along and above the rear side 20 of the tub 14. The tub 14 and enclosure 29 are left open for access over the front side 18 of the tub and between the front vertical end wall edges 30A of the enclosure.

A shower nozzle 34 is mounted from one of the bathroom end walls 30 above a corresponding one opposite end 16 of the tub 14. The shower curtain 12 is provided to prevent the spray of water issued by the shower nozzle 34 from deflecting and splashing from the user's body and the tub interior 28 and enclosure walls 30 and 32 surrounding the tub 14 into the rest of the bathroom during use of the shower.

Referring to FIGS. 1 and 2, the shower curtain support fixture 10 of the present invention basically includes a generally U-shaped structure 36 of hollow tubular construction, either circular or square in cross-section, and fabricated of any suitable material, such as extruded steel or aluminum. The structure 36 has an elongated straight main portion 36A, a pair opposite straight end portions 36B extending in generally transverse relation to the main portion 36A, and a pair of curved corner portions 36C connecting the end portions 36B to the main portion 36A. A slot 38 is defined in a bottom side (as seen in FIG. 2) of the U-shaped structure 36, extending along the main portion 36A, the curved corner portions 36C and the opposite end portions 36B of the structure so as to provide a generally U-shaped guide track. The slot 38 terminates at opposite ends 38A spaced from the opposite ends 36D of the U-shaped structure 36.

The support fixture 10 also includes a plurality of shower curtain hanger devices 40 inserted through the slot 38 in the bottom side of the U-shaped structure 36. As seen in FIGS. 3-5, the hanger devices 40 each includes upper and lower spherical glides 42 and 44 spaced apart and connected by a link 46 and having a shower curtain attachment ring 48 attached to and extending below the lower glide 44. The upper glide 42 is disposed inside of the hollow structure 36 above its lower side and overlying the slot 38, the link 46 extends downward through the slot 38 and the lower glide 44 is disposed along the exterior of the lower side of the structure 36. The hanger device 40 are individually slidable along the guide track provided by the slot 38.

Finally, as best seen in FIGS. 1, 2 and 5, the support fixture 36 includes means on the opposite end portions 36B of the U-shaped structure 36 in the form of a plurality of spaced pairs of horizontally aligned inner and outer holes 50 and 52 formed respectively through inner and outer sides of the structure 36 for facilitating mounting of the structure 36 with its opposite end portions 36B extending in flush contacting relation to bathroom end walls 30 disposed at the opposite ends 16 of the tub 14. The inner hole 50 of each pair thereof is larger in diameter than the outer hole 52. The size of the inner hole 50 permits passage of a screw fastener 54 completely through it and also permits the tip of a screw driver (not shown) to be inserted through it to engage the head 54A of the screw fastener 54 in order to attach the structure end portion 36B flush against the bathroom end wall 30. It can be readily seen in FIG. 5 that the head 54A is too large in diameter to pass through the outer hole 52. Caps can be provided to insert into the inner holes 50 and seal the same after the screw fasteners 54 are installed in order to prevent water from entering the hollow structure 36 through the inner holes 50.

As can be seen in FIGS. 1 and 2, the main portion 36A of the U-shaped structure 36 is generally aligned above the front side 18 of the tub and extends between the front vertical edges 30A of the bathroom end walls 30. In such position, the shower curtain 12 will hang from the main and opposite end portions 36A and 36B of the structure 36, via the hanger devices 40, downward into the interior 28 of the tub 14, extending along the interior of the front side 18 of the tub 1 and around the interior of the front opposite corners 24 thereof. By way of example, the end portions 36B of the structure 36 and thus the opposite ends of the shower curtain can extend into the tub cavity or interior as much as ten inches at each end. In such manner, the shower curtain 12 will effectively block water from splashing out of the tub 14 over the front side 18 and front opposite corners 24 of the tub 14. The curved corners 36C of the U-shaped structure 36 can be configured to substantially match the curvatures of the front corners 24 of the bath tub 14.

In the exemplary configuration of FIGS. 1 and 2, the U-shaped structure 36 is composed of a pair of generally L-shaped support members 58 and 60 being interfitted together. In particular, one L-shaped support member 58 is telescopably inserted into the other support member 60 to define the U-shaped configuration of the structure 36 and permit adjustment of the length of its main portion for fitting it to different distances between bathroom end walls 30. The two piece construction of the structure 36 allows the support fixture 10 to be adjusted for all applications, from a 3-foot shower stall, up to and including a 6-foot oversized bath tub.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A shower curtain support fixture for hanging a shower curtain above a bath tub, which tub has at least two oppositely facing walls disposed at opposite ends of the tub, comprising:

(a) a generally U-shaped tubular structure having an elongated generally straight main portion and a pair of opposite end portions extending in generally transverse relation to the ends of said main portion, said U-shaped structure comprising a pair of generally L-shaped tubular structures telescopably inserted, one into the other, so as to define an adjustable length U-shaped structure that exactly fits between said facing walls;

(b) a generally U-shaped guide track slot extending along the bottom of said main portion and the bottom of said opposite end portions;

(c) means for hanging a shower curtain from said guide track slot comprising glides within said tubular structure connected to the curtain by links extending downward through said slot so as to permit moving the curtain therealong; and (d) means on said opposite end portions of said structure for mounting said opposite end portions flush to said oppositely facing walls such that the shower curtain hangs flush against oppositely facing walls so as to effectively block water from splashing out of the tub over the side of the tub and between the curtain and walls, said means for mounting including a plurality of pairs of aligned holes formed through said opposite end portions of said structure and an inner one of said holes in each pair thereof is larger than an outer one of said holes for permitting passage of a fastener completely through said inner hole but not completely through said outer hole.

* * * * *